US008602910B2

(12) United States Patent
Swartz

(10) Patent No.: US 8,602,910 B2
(45) Date of Patent: Dec. 10, 2013

(54) GOLF CLUB HEADS WITH EDGE CONFIGURATION AND METHODS TO MANUFACTURE GOLF CLUB HEADS

(75) Inventor: Gregory J. Swartz, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 382 days.

(21) Appl. No.: 12/875,685

(22) Filed: Sep. 3, 2010

(65) Prior Publication Data

US 2012/0034997 A1 Feb. 9, 2012

Related U.S. Application Data

(60) Provisional application No. 61/371,461, filed on Aug. 6, 2010.

(51) Int. Cl.
*A63B 53/04* (2006.01)

(52) U.S. Cl.
USPC ..... 473/328; 473/350

(58) Field of Classification Search
USPC ..... 473/324–350
See application file for complete search history.

(56) References Cited

U.S. PATENT DOCUMENTS

| | | | | | |
|---|---|---|---|---|---|
| 1,683,838 | A | | 5/1927 | Mooney | |
| 1,693,889 | A | | 6/1927 | Dick | |
| 1,705,997 | A | * | 3/1929 | Williams | 473/329 |
| 1,854,548 | A | * | 4/1932 | Hunt | 473/329 |
| 1,880,351 | A | | 10/1932 | McDonald | |
| 1,890,362 | A | | 12/1932 | Bellow | |
| 2,661,174 | A | | 9/1950 | Sands | |
| 3,061,310 | A | * | 10/1962 | Giza | 473/329 |
| D240,949 | S | * | 8/1976 | Jones | D21/741 |
| 4,398,965 | A | * | 8/1983 | Campau | 148/522 |
| 4,676,464 | A | | 6/1987 | Reimers | |
| 4,778,136 | A | | 10/1988 | Reimers | |
| 5,330,187 | A | * | 7/1994 | Schmidt et al. | 473/291 |
| 5,356,003 | A | | 10/1994 | Gretz et al. | |
| 5,380,009 | A | * | 1/1995 | Henry et al. | 473/346 |
| 5,437,456 | A | * | 8/1995 | Schmidt et al. | 473/291 |
| 5,472,203 | A | * | 12/1995 | Schmidt et al. | 473/350 |
| 5,474,176 | A | | 12/1995 | Schenkkan | |
| 5,492,327 | A | * | 2/1996 | Biafore, Jr. | 473/332 |
| 5,749,795 | A | * | 5/1998 | Schmidt et al. | 473/350 |
| 6,086,485 | A | * | 7/2000 | Hamada et al. | 473/329 |
| 6,348,013 | B1 | * | 2/2002 | Kosmatka | 473/329 |
| 6,368,232 | B1 | * | 4/2002 | Hamada et al. | 473/329 |
| 7,211,006 | B2 | * | 5/2007 | Chang | 473/329 |
| 7,294,064 | B2 | * | 11/2007 | Tsurumaki et al. | 473/329 |
| 7,396,293 | B2 | * | 7/2008 | Soracco | 473/329 |
| 7,500,924 | B2 | * | 3/2009 | Yokota | 473/332 |
| 7,582,024 | B2 | * | 9/2009 | Shear | 473/329 |
| 7,857,711 | B2 | * | 12/2010 | Shear | 473/329 |
| 8,083,612 | B2 | * | 12/2011 | Stites et al. | 473/345 |
| 8,235,844 | B2 | * | 8/2012 | Albertsen et al. | 473/345 |

FOREIGN PATENT DOCUMENTS

| | | | | | |
|---|---|---|---|---|---|
| GB | 2399506 | A | * | 9/2004 | A63B 53/04 |
| JP | 04180778 | A | * | 6/1992 | A63B 53/04 |
| JP | 10005378 | A | * | 1/1998 | A63B 53/04 |
| JP | 10263118 | A | * | 10/1998 | A63B 53/04 |

(Continued)

*Primary Examiner* — Alvin Hunter

(57) ABSTRACT

Embodiments of golf club heads with an edge configuration and methods to manufacture golf club heads are generally described herein. Other embodiments of golf club heads with an edge configuration may be described and claimed.

23 Claims, 8 Drawing Sheets

(56) References Cited

FOREIGN PATENT DOCUMENTS

| | | | | | |
|---|---|---|---|---|---|
| JP | 2001000601 | A | * | 1/2001 | A63B 53/04 |
| JP | 2002248183 | A | * | 9/2002 | A63B 53/04 |
| JP | 2002306648 | A | * | 10/2002 | A63B 53/04 |
| JP | 2003024481 | A | * | 1/2003 | A63B 53/04 |
| JP | 2004275700 | A | * | 10/2004 | A63B 53/04 |
| JP | 2004351173 | A | * | 12/2004 | A63B 53/04 |
| JP | 2005168831 | A | * | 6/2005 | A63B 53/04 |
| JP | 2005253562 | A | * | 9/2005 | A63B 53/04 |
| JP | 2007136069 | A | * | 6/2007 | |
| JP | 2010279847 | A | * | 12/2010 | |

* cited by examiner

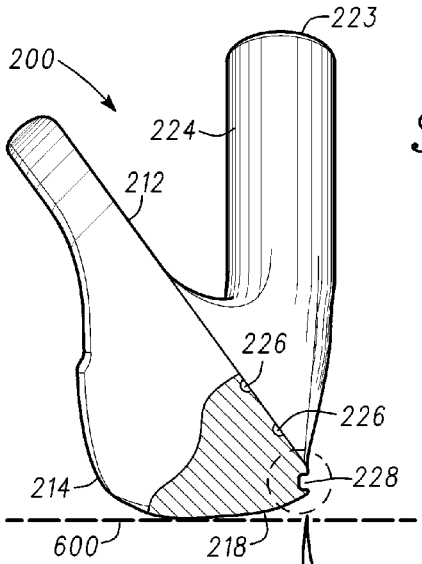
Fig. 6
Fig. 7
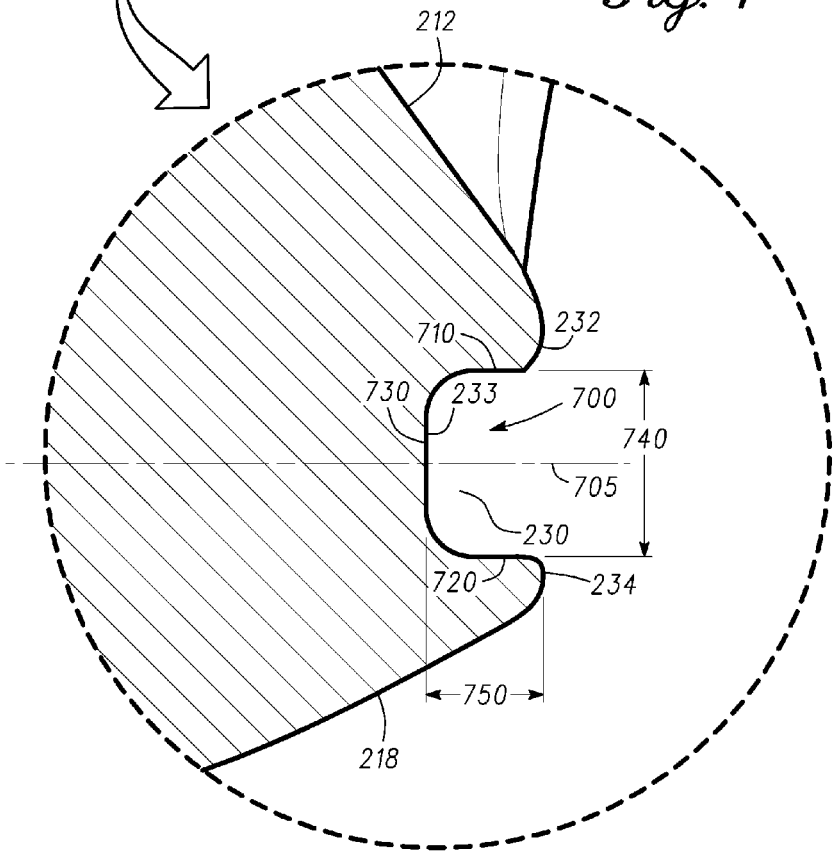

GOLF CLUB HEADS WITH EDGE CONFIGURATION AND METHODS TO MANUFACTURE GOLF CLUB HEADS

CROSS REFERENCE TO RELATED APPLICATION

This application claims the benefit of U.S. Provisional Application 61/371,461, filed Aug. 6, 2010. The disclosure of the referenced application is incorporated herein by reference.

FIELD

The present disclosure relates to golf club heads with an edge configuration and methods to manufacture such golf club heads, and in particular a golf club head with an edge configuration that defines a channel between the face and sole of the golf club head.

BACKGROUND

Golf club heads currently have a leading edge defining a smooth radius that transitions from the face to the sole of a golf club head. This type of leading edge is designed to cut through soil and possibly create a divot. Although a golf club head with a leading edge defining a smooth radius has proven satisfactory in most shot situations, shots made from deep and/or wet grass present certain challenges. In particular, an individual who strikes the ball in deep grass can have the golf club head twist as it contacts and breaks the tall blades of grass. Further, debris such as dirt, grass and/or water can cause the golf ball to "slide up", rather than "roll up", the face of the golf club head after impact since such debris can impede the progress of the golf ball as it travels along the face of the golf club head after impact. In addition, golf club heads with a smooth radius along the leading edge also can inhibit the golf club head from shearing blades of grass when the golf club is swung through the rough, especially for individuals who may hit low on the face of the golf club head. To address these issues, the leading edge of the golf club head may be sharpened. However, a sharpened leading edge can cut the ball and cause the golf club head to dig into the ground once the golf club head comes into contact with the soil.

BRIEF DESCRIPTION OF THE DRAWINGS

FIG. 6 is a side view of the golf club head illustrating another embodiment of an edge configuration;

FIG. 7 is an enlarged view of the golf club head shown in FIG. 6 illustrating another configuration of a leading edge;

Corresponding reference characters indicate corresponding elements among the view of the drawings. The headings used in the figures should not be interpreted to limit the scope of the claims.

DESCRIPTION OF EXAMPLES OF EMBODIMENTS

Golf club heads typically have a leading edge with a smooth radius that transitions from the face to the sole of a golf club head. When swinging out of rough or other tall grass areas, the smooth radius leading edge may not provide optimal performance in such playing conditions. For instance, the leading edge with a smooth radius tends to break, rather than cleanly shear the tall grass, thereby causing the golf club head to become twisted as the golf club is swung through the grass. In addition, golf club heads with a leading edge having a smooth radius can also cause the golf ball to "slide up" the face of the golf club head after impact, rather than "roll up" the face of the golf club head. By sliding up the face instead of rolling up, the golf ball may engage from the face and rotate in a manner that may result in non-optimal ball flight trajectory.

As such, the golf club head with an edge configuration defining a channel and method of manufacturing such an edge configuration as described herein may provide optimal performance in certain playing conditions by configuring the leading edge of the club head to address these issues.

Figure 1:
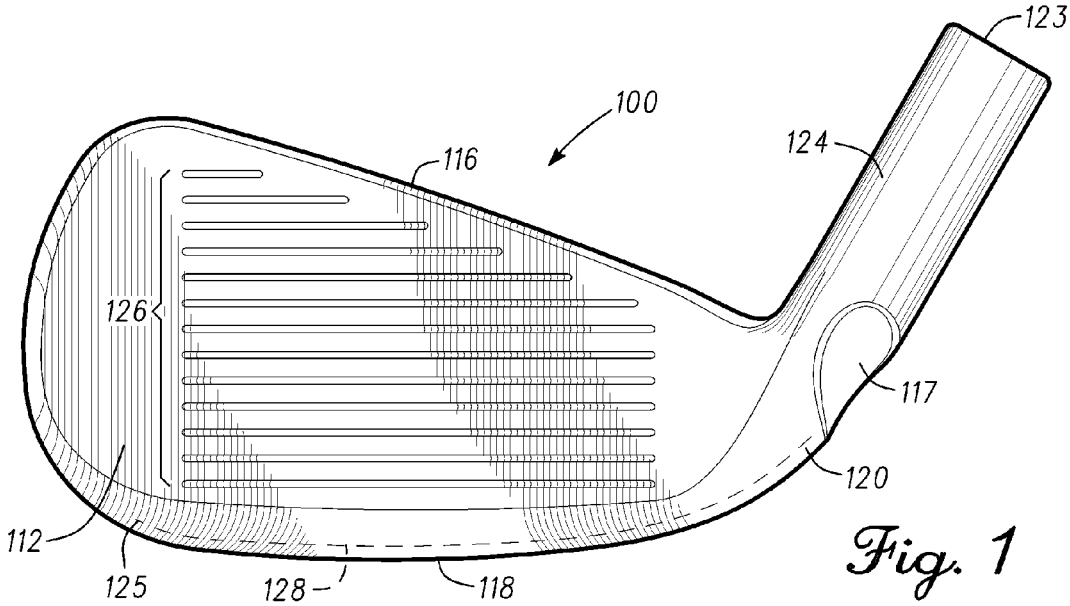
FIG. 1 is a front view showing one embodiment of an edge configuration.

Referring to the drawings, an embodiment of a golf club head is illustrated and generally indicated as 100 in FIG. 1. In general, the golf club head 100 may include a face 112, a sole 118, a heel 120, a hosel 124, a toe 125, and a plurality of grooves 126. The golf club head 100 may be a single piece or include multiple portions manufactured together. In one example, the golf club head 100 may be a single piece formed by a casting process or other suitable type of manufacturing processes. In particular, the face 112 may be an integral part of the golf club head 100. Alternatively, the face 112 may be a separate piece from or an insert for a body of the golf club head 100.

To form a golf club, the hosel 124 defines an aperture 123 configured to engage a shaft (not shown). In particular, the shaft may engage the golf club head 100 on one end and engage a grip (not shown) on an opposite end. For example, the golf club may be an iron-type golf club (e.g., 1-iron golf club, 2-iron golf club, a 3-iron golf club, a 4-iron golf club, a 5-iron golf club, a 6-iron golf club, a 7-iron golf club, an 8-iron golf club, or a 9-iron golf club, etc.), a wedge-type golf club (e.g., pitching wedge golf club, lob wedge golf club, sand wedge golf club, utility wedge golf club, n-degree wedge golf club (e.g., 44 degrees (°), 48°, 52°, 56°, 60°, etc.), or any other suitable type of golf clubs. While FIGS. 1, 2, and 3 may depict a hosel 124, the apparatus, articles of manufacture, and methods described herein may include a bore instead of a hosel 124 to engage a shaft.

In addition, the face 112 may be formed adjacent the hosel 124 and provides a surface for striking a golf ball (not shown). The face 112 may be made of steel material, titanium material, titanium alloy material, titanium-based material, a combination thereof, or other suitable type of materials. In particular, the face 112 may include a plurality of grooves, generally shown as 126, 226 and 326 in FIGS. 1, 2, and 3. Although the plurality of grooves 126, 226 and 326 may conform to rules and/or standards of golf defined by various golf standard organizations, governing bodies, and/or rule establishing entities, the apparatus, articles of manufacture, and methods described herein are not limited in this regard. The golf club head 100 further includes a back 114 (FIG. 4) formed opposite the face 112 and the sole 118 defined between the back 114 and the face 112. As further shown, the face 112 is defined by the heel 120 formed adjacent the hosel 124 and the toe 125 defined at the far end of the face 112. The face 112 further includes a top edge 116 defined at the top of the face 112 and a leading edge 128 that transitions between the face 112 and the sole 118.

Figure 4:
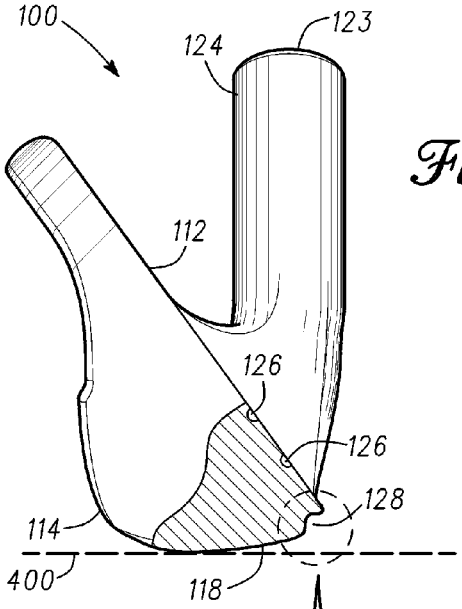
FIG. 4 is a side view of the golf club head illustrating an embodiment of an edge configuration.
Figure 5:
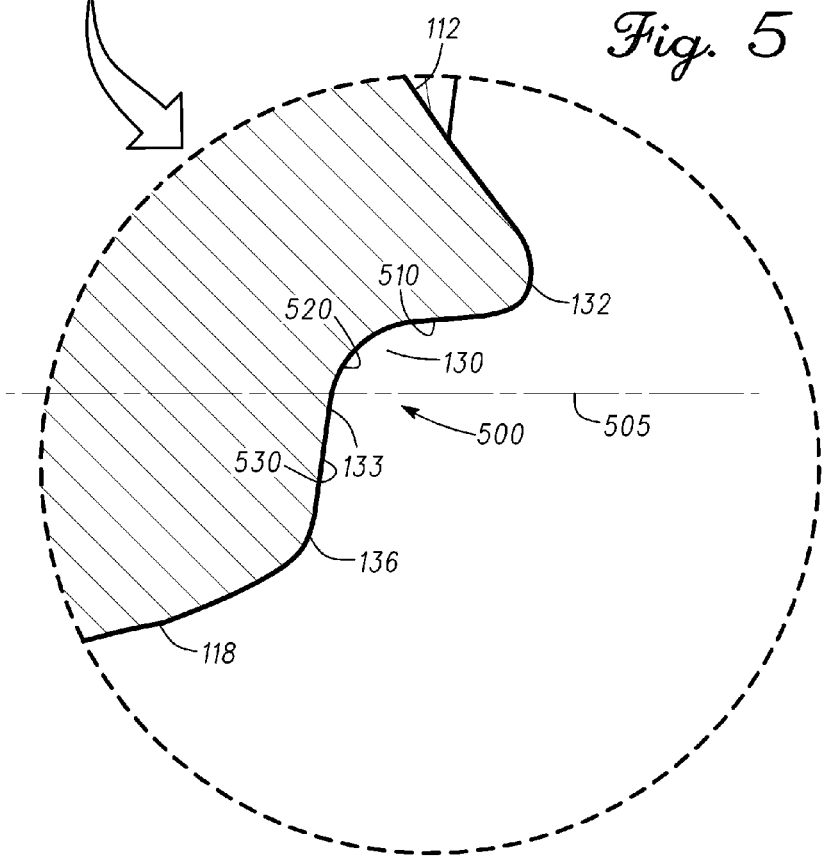
FIG. 5 is an enlarged view of the golf club head shown in FIG. 4 illustrating one configuration of a leading edge.

In one embodiment shown in FIGS. 4 and 5, the leading edge 128 defines an edge configuration 500 that includes a channel 130 defined by an upper face portion 132 and an opposing lower sole portion 136 defined adjacent a side portion 133 of channel 130. In this particular embodiment, the channel 130 may be defined by a lower sole portion 136, which tapers away from the upper face portion 132, thereby providing a more open configuration to the channel 130. The channel 130 of the edge configuration 500 may include a first wall 510, a second wall 520, and a third wall 530. In particular, the first wall 510 may be symmetrical relative to an axis 505, which is substantially parallel to a ground plane 400, while the third wall 530 is substantially perpendicular relative to axis 505 and tapers away from the second wall 520.

The channel 130 is also configured to receive portions of a hitting surface (not shown) such as the ground of a fairway or rough of a golf course, when the leading edge 128 impacts the hitting surface. The configuration of the channel 130 to receive portion of debris also allows the golf ball to "roll up" the face 112, rather than "slide up" the face 112 after impact since the channel 130 clears the face 112 of any debris, such as dirt, grass, and/or water. As such, there is a greater coefficient of friction generated between the face 112 and the golf ball that causes the golf ball to "roll up" the face 112 unimpeded in comparison to when debris is present between the face 112 and the golf ball which impedes the golf ball and generates a smaller coefficient of friction between the face 112 and the golf ball, thereby causing the golf ball to "slide up" the face 112 when the leading edge 128 has a smooth radius. Accordingly, the channel 130 may clear out water, sand, grass, and/or other debris between a golf ball and the golf club head 100 to generate a much greater coefficient of friction between the golf ball and the face 112 of the golf club head 100.

Referring to FIGS. 6 and 7, another embodiment of the golf club head, designated 200, is substantially similar to golf club head 100. In particular, the golf club head 200 includes a face 212 is defined by the heel 220 formed adjacent the hosel 224 and the toe 225 defined at the far end of the face 212. The face 212 further includes a top edge 216 defined at the top of the face 212 and a leading edge 228 that transitions between the face 212 and the sole 218 with the hosel 224 defining an aperture 223 configured to engage a shaft. The golf club head 200 further includes a back 214 formed opposite the face 112. In one embodiment, the leading edge 228 may include an edge configuration 700 configured to include a channel 230 that defines an upper face side portion 232 that is substantially parallel to the lower sole portion 234 defined adjacent a side portion 233.

In this embodiment, the upper face portion 232 and the lower sole portion 234 extend outwardly at substantially the same distance relative to each other. In particular, the channel 230 of the edge configuration 700 may be symmetrical relative to an axis 705, which is substantially parallel to a ground plane 600. The channel 230 of the edge configuration 700 may include a first wall 710, a second wall 720, and a third wall 730. In contrast to the edge configuration 500 (FIG. 5), the edge configuration 700 may include an additional portion (i.e., the second wall 720) to form a C-shaped channel (i.e., the channel 230). The first and second walls 710 and 720 may be substantially parallel to each other. Alternatively, the first and second walls 710 and 720 may taper towards the third wall 730. Similar to the channel 130 of FIGS. 4 and 5, the channel 230 may clear out water, sand, grass, and/or other debris between a golf ball and the golf club head 200. For example, in one embodiment the channel 230 may have a width 740 of 0.035 inches and a depth 750 that may be 0.020 inches or less, while the radius of the upper face portion 232 may be in the range of 0.010 inches to 0.020 inches. The apparatus, articles of manufacture, and methods described herein are not limited in this regard.

Figure 8:
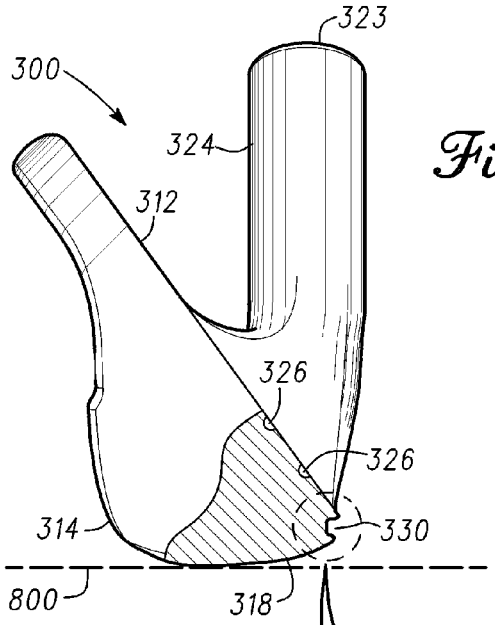
FIG. 8 is a side view of the golf club head illustrating yet another embodiment of an edge configuration.
Figure 9:
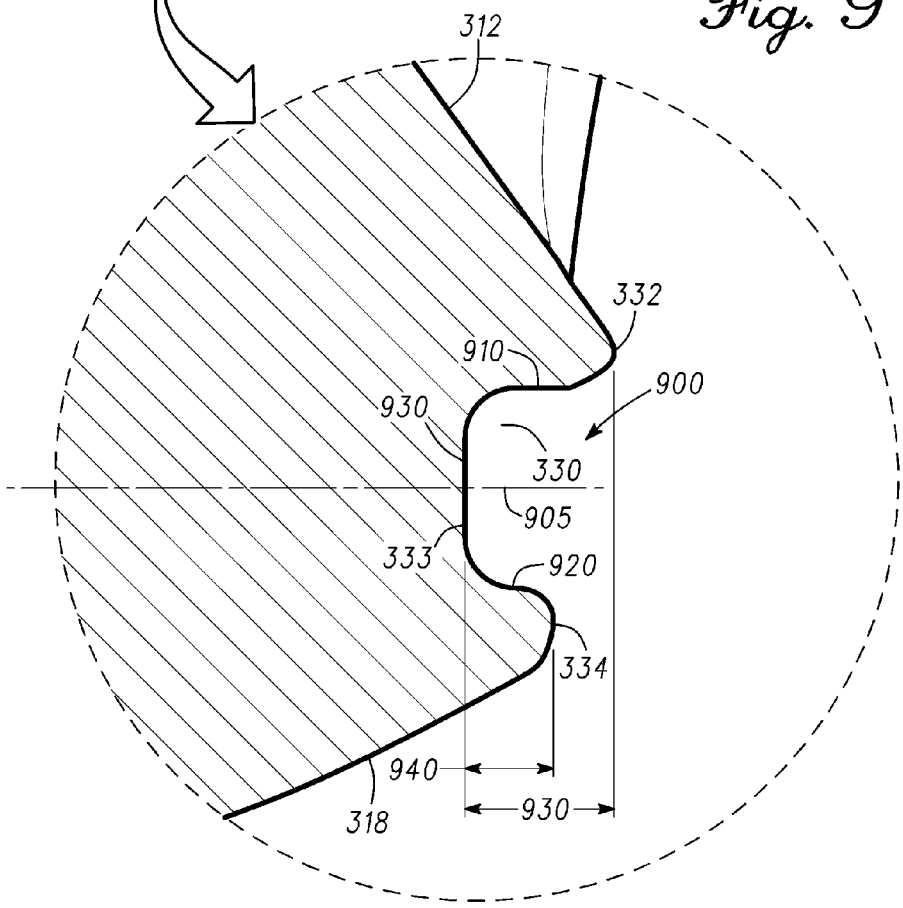
FIG. 9 is an enlarged view of the golf club head shown in FIG. 8 illustrating yet another configuration of a leading edge.

As shown in FIGS. 8 and 9, for example, another embodiment of the golf club head, designated 300, is substantially similar to golf club head 200. In particular, the golf club head 300 includes a face 312 defined by the heel 320 formed adjacent the hosel 324 and the toe 325 defined at the far end of the face 312. The face 312 further includes a top edge 316 defined at the top of the face 312 and a leading edge 328 (e.g., FIG. 3) that transitions between the face 312 and the sole 318 with the hosel 324 defining an aperture 323 configured to engage a shaft. The golf club head 300 further includes a back 314 formed opposite the face 312. In one embodiment, the leading edge 328 may include an edge configuration 900 configured to include a leading edge 328 having a channel 330 that defines an upper face portion 332 substantially parallel to the lower sole portion 334 defined adjacent a side portion 333. In this configuration, the upper face portion 332 extends more outwardly from the face 312 relative to the lower sole portion 334, although the side portion 333 has the same configuration as the channel 230 (e.g., FIGS. 6 and 7). In contrast to the edge configuration 700 shown in FIGS. 6 and 7, the edge configuration 900 shown in FIGS. 8 and 9 may be non-symmetrical relative to an axis 905.

In particular, the channel 330 of the edge configuration 900 may include a first wall 910, a second wall 920, and a third wall 930. Similar to the first and second walls 710 and 720 of the edge configuration 700 (FIG. 7), the first and second walls 910 and 920 of the edge configuration 900 may also be substantially parallel to each other. In contrast to the first and second walls 710 and 720 of the edge configuration 700 (FIG. 7), the first wall 910 may be longer than the second wall 920. The first wall 910 may be associated with a first height 930 whereas the second wall 920 may be associated with a shorter second height 940. Accordingly, the first height 930 is greater than the second height 940. Alternatively, the first wall 910 may be shorter than the second wall 920 (e.g., the first height 930 is less than the second height 940). Similar to the channels 130 (FIGS. 4 and 5) and 230 (FIGS. 6 and 7), the channel 330 may clear out water, sand, grass, and/or other debris between a golf ball and the golf club head.

Although the above example may describe and FIGS. 6 and 7 may depict an edge configuration with a C-shaped channel, the apparatus, articles of manufacture, and methods described herein may include edge configurations with channels having other suitable cross-section profiles, a V-shaped cross-section profile (FIG. 14), a W-shaped cross-section profile (FIG. 15) or a square-shaped cross-section profile (FIG. 16) as shall be described in greater detail below.

Figure 14:
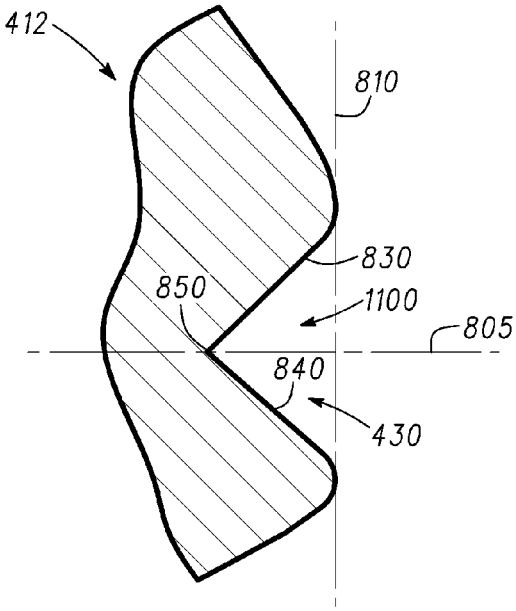
FIG. 14 is an enlarged side view of the golf club head illustrating a V-shaped edge configuration.

Referring to FIG. 14, an embodiment of face 412 may include an edge configuration 1100 having a channel 430 that defines a V-shaped cross-section profile with a first wall 830 and a second wall 840 that meet a point 850. In particular, the first wall 830 and second wall 840 may be symmetrical relative to an axis 805 and extend from point 850 to a plane 810 that is perpendicular to axis 805.

Figure 15:
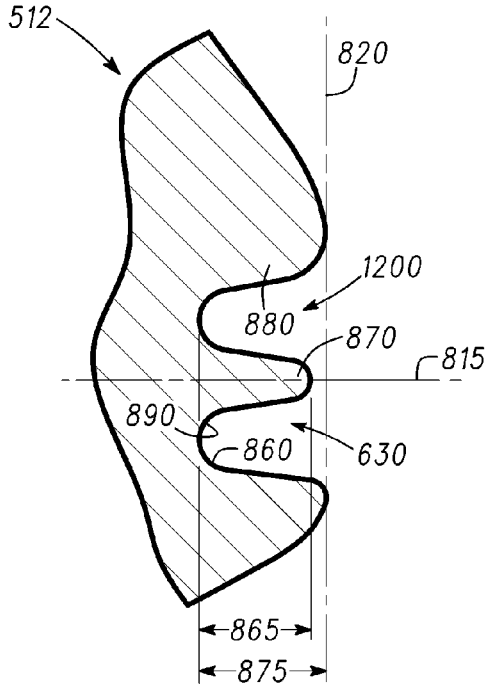
FIG. 15 is an enlarged side view of the golf club head illustrating a W-shaped edge configuration.

As shown in FIG. 15, an embodiment of face 512 may include an edge configuration 1200 having a channel 630 that defines a W-shaped cross-section profile with a first wall 860 and a second wall 880 that define a middle portion 870. In particular, the first wall 860, middle portion 870 and second wall 880 are substantially symmetrical relative to an axis 815, while the first wall 860 and second wall 880 extend outwardly to a plane 820. In one embodiment, the second wall extends a first distance 865, while first wall 860 and second wall 880 extend a second distance 875 with the first distance 865 being greater than the second distance 875. However, in other embodiments, the second distance 875 may be greater than the first distance 865. While FIG. 15 may depict a rounded peak, the middle portion 870 may include a pointed peak. Alternatively, the middle portion 870 may include a truncated or flat top portion. The apparatus, articles of manufacture, and methods described herein are not limited in this regard.

Figure 16:
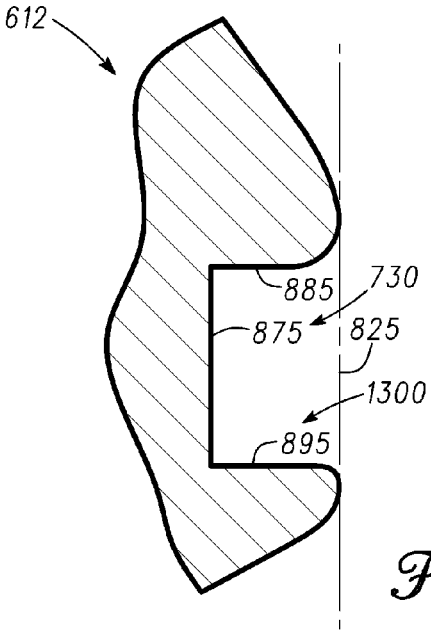
FIG. 16 is an enlarged side view of the golf club head illustrating a square-shaped edge configuration.

Referring to FIG. 16, an embodiment of face 612 may include an edge configuration 1300 having a channel 730 that defines a square-shaped cross-section profile with a first wall 885, second wall 875 and third wall 895. Specifically, the second wall 875 may be symmetrical relative to a plane 825 and the first wall 885 and third wall 895 may be perpendicular relative to plane 825. The first and second walls 885 and 875 may be substantially perpendicular to each other. In a similar manner, the second and third walls 875 and 895 may also be substantially perpendicular to each other.

Figure 2:
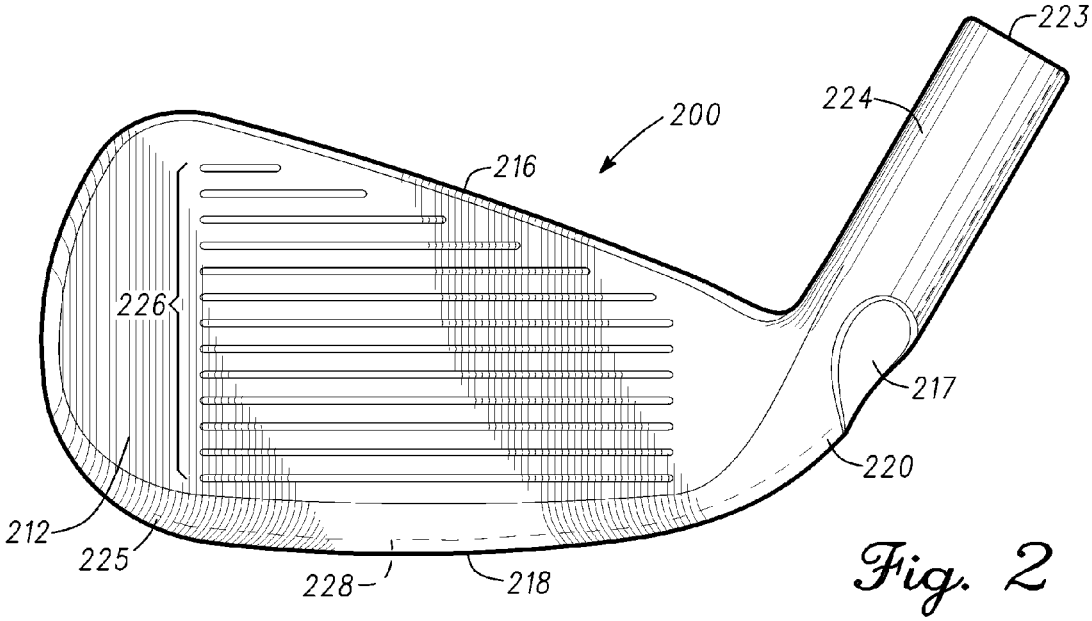
FIG. 2 is a front view showing another embodiment of an edge configuration.

In the embodiment shown in FIG. 1, golf club head 100 may include an edge configuration with any one of the channels 130, 230, 330, 430, 630 and 730 described above defined along the leading edge 128 between the heel 120 and toe 125 as illustrated by the phantom line. Referring to FIG. 2, another embodiment of golf club head, designated 200, may also include any of the channels 130, 230, 330, 430, 630 and 730 described above defined along leading edge 228 between the hosel 224 and toe 225 as illustrated by the phantom line. In particular, the edge configuration of the club head 200 of FIG. 2 may extend beyond the heel 220 and towards the hosel 224 (i.e., the edge configuration of the club head 200 shown in FIG. 2 may be longer than the edge configuration of the club head 100 (FIG. 1).

Referring back to FIG. 3, one embodiment of the golf club head, designated 300, may include any of the embodiments of channels 130, 230, 330, 430, 630 and 730 described above defined along the leading edge 328 between the hosel 324 and substantially to a point 322 located at the far end of the top edge 316. That is, the edge configuration of the golf club head 300 of FIG. 3 may further extend beyond the leading edge 328 on of the sole 318. Accordingly, the edge configuration of the golf club head 300 of FIG. 3 may be relatively longer than both the edge configurations of the golf club heads 100 and 200 of FIGS. 1 and 2, respectively.

Figure 17:
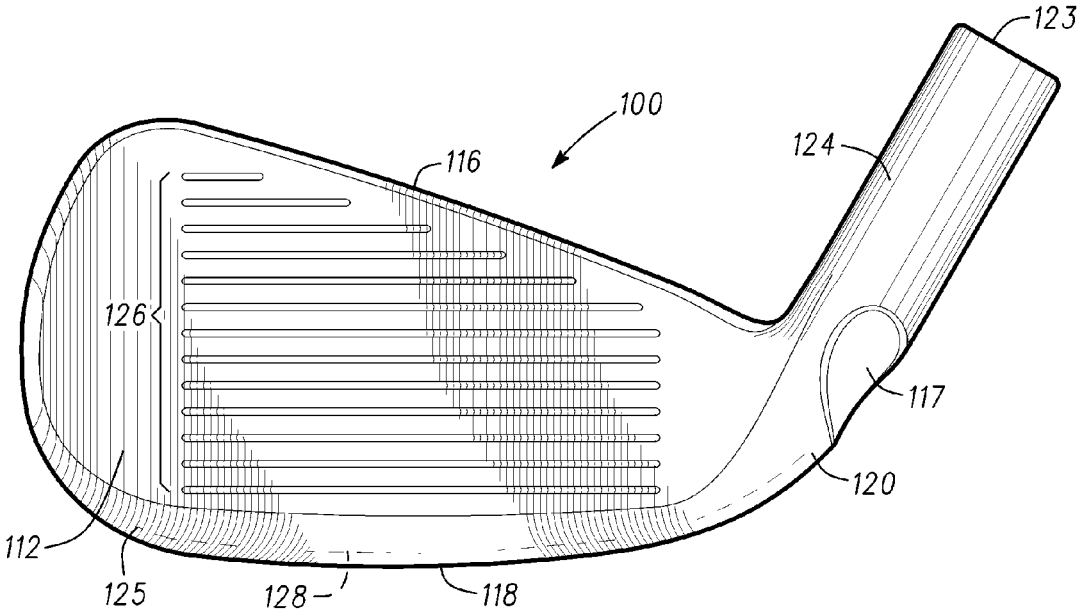
FIG. 17 is a front view showing one embodiment of an edge configuration having a plurality of segments.

While the above examples may describe and depict substantially continuous edge configurations, the apparatus, articles of manufacture, and the methods described herein may include segmented leading edge configurations. Referring back to FIG. 1, for example, the edge configuration of the golf club head 100 may be divided into two or more sections (e.g., FIG. 17) between the toe 125 and the heel 120. Although the size and the shape of an edge configuration may be substantially the same from one end to the other (e.g., between the toe 125 and the heel 120), the apparatus, articles of manufacture, and methods described herein are not limited in this regard. That is, a channel of an edge configuration may change in size and/or shape from one end to the other.

Figure 11:
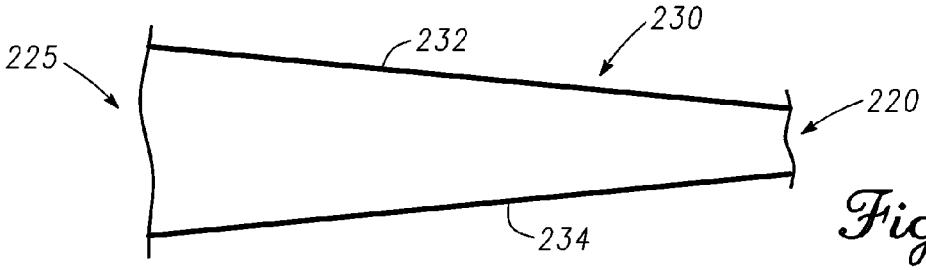
FIG. 11 is a simplified illustration showing a symmetrical tapered edge configuration along a leading edge.
Figure 12:
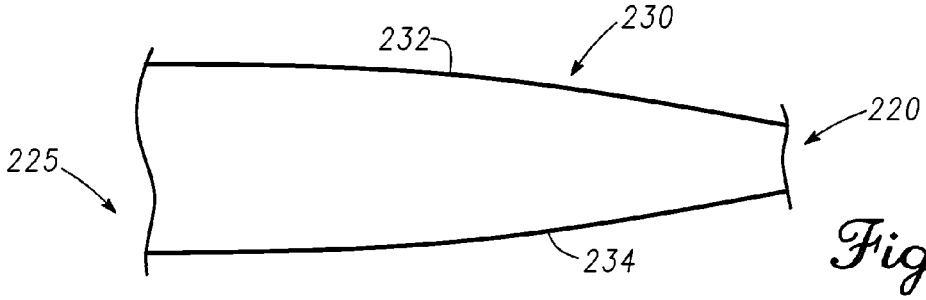
FIG. 12 is a simplified illustration showing a non-symmetrical tapered edge configuration along the leading edge.

In one example shown in FIGS. 11 and 12, the size of the channel 230 may be tapered from the toe 225 to the heel 220 in a linear or non-linear manner. In particular, the upper face portion 232 and lower sole portion 234 shown in FIG. 11 may be symmetrically tapered from the toe 225 to the heel 220 in a linear manner, while the upper face portion 232 and lower sole portion 234 shown in FIG. 12 may be non-symmetrically tapered from the toe 225 to the heel 220 in a non-linear manner.

Figure 13:
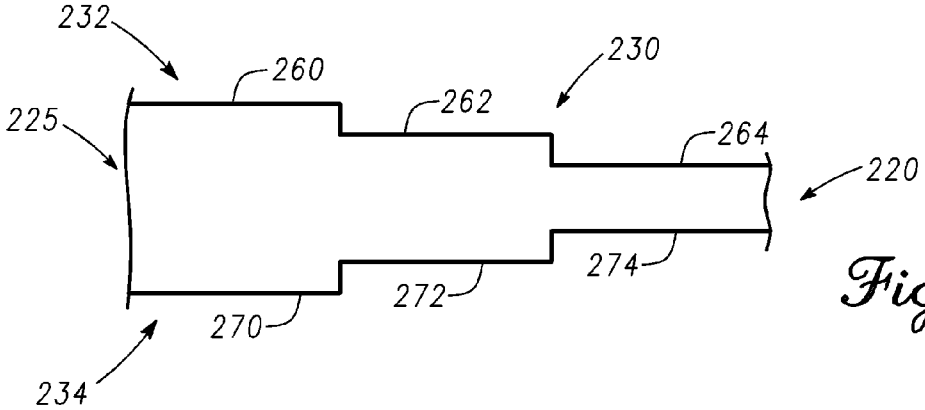
FIG. 13 is a simplified illustration showing a square toothed edge configuration along a leading edge.

As shown in another example in FIG. 13, the channel 230 may have a stair-step configuration defined by three successive square-shaped portions extending from the toe 225 to the heel 220. In particular, the channel 230 may include a first rectangular-shaped portion defined by a first wall 260 and an opposing second wall 270, a second rectangular-shaped portion defined by a third wall 262 and an opposing fourth wall 272, and a third rectangular-shaped portion defined by a fifth wall 264 and an opposing sixth wall 274. In this embodiment, the first, second and third rectangular-shaped portions may have successively greater diameters from the first rectangular-shaped portion to the third rectangular-shaped portion. Alternatively, the first, second and third rectangular-shaped portions may have successively smaller diameters from the first rectangular-shaped portion to the third rectangular-shaped portion.

In another example, an edge configuration may have a C-shaped channel proximate to the toe 225 and a V-shaped channel proximate to the heel 220. The apparatus, articles of manufacture, and methods described herein are not limited in this regard.

Figure 3:
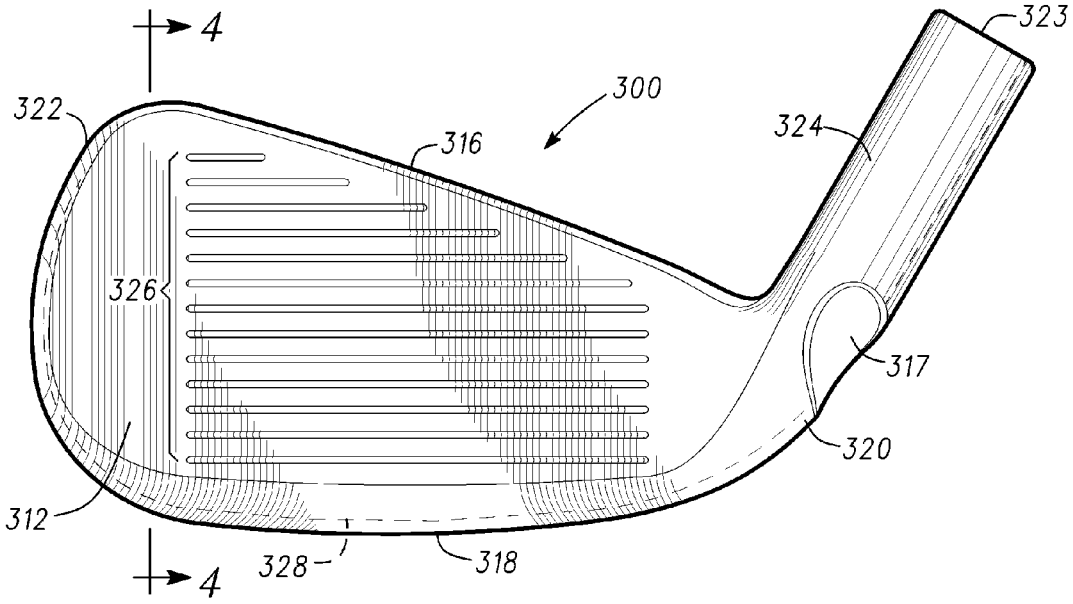
FIG. 3 is a front view showing yet another embodiment of an edge configuration.

Although FIGS. 1, 2, and 3 may depict an iron-type club head or a wedge-type club head, the apparatus, articles of manufacture, and methods described herein may be applicable to other types of golf club head (e.g., a driver-type golf club head, a fairway wood-type golf club head, a hybrid-type golf club head, a putter-type golf club head, etc.). Further, while FIGS. 1, 2, and 3 may depict a heel notch 117, 217 or 317 to adjust the loft and/or the lie of the golf club heads 100, 200 and 300, respectively, the apparatus, articles of manufacture, and methods described herein are not limited in this regard.

Figure 10:
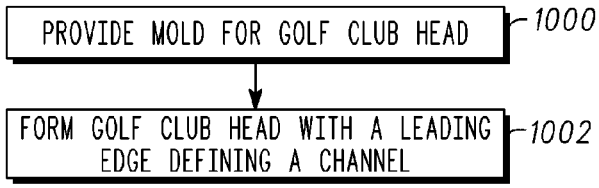
FIG. 10 is a flow chart illustrating a method for manufacturing a golf club head with an edge configuration.

Referring to FIG. 10, a flow chart illustrates one method for manufacturing a golf club head 100 with a leading edge 128 defining a channel 130. At block 1000, a mold (not shown) is provided for forming the golf club head 100. At block 1002, the golf club head is 100 is formed using the mold having the hosel 124 defining the aperture 123 configured to engage the shaft. The face 112 defined by the mold is defined by the toe 125, heel 120, top edge 116, and leading edge 128 that transitions between the face 112 and sole 118, wherein the channel 130 is formed along the leading edge 128 having an upper face portion 132 and a lower sole portion 136 that collectively define the side portion 133. In one embodiment, the club head 100 including the channel 130 may be formed using a casting process known in the art, while in another embodiment the golf club head 100 including channel 130 may be formed using a milling process known in the art. In the alternative, the channels 130, 230, 330, 430, 630 and 730 may be formed by other suitable types of manufacturing processes (e.g., forged, machined, etc.).

Furthermore, the golf club heads with edge configuration and methods of manufacture discussed herein may be implemented in a variety of embodiments, and the foregoing discussion of these embodiments does not necessarily represent a complete description of all possible embodiments. Rather, the detailed description of the drawings, and the drawings themselves, disclose at least one preferred embodiment of golf club heads with edge configuration and methods of manufacture, and may disclose alternative embodiments of golf clubs and methods of manufacture. It is intended that the scope of golf club heads with edge configuration and methods of manufacture shall be defined by the appended claims.

All elements claimed in any particular claim are essential to golf clubs or methods of manufacture claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A golf club head comprising:
a hosel defining an aperture configured to engage a shaft;
a face formed adjacent the hosel, the face being defined by a heel, a toe, a top edge, and a leading edge,
a back defined opposite the face,
a sole defined between the face and the back, and
an edge configuration that is a boundary between the face and the sole with the edge configuration having a channel that tapers away from the boundary between the face and the sole, wherein the sole forms a lower sole and the face forms an upper face, wherein the lower sole is substantially parallel to the upper face.

2. The golf club head of claim 1, wherein the lower sole tapers away relative to the upper face.

3. The golf club head of claim 1, wherein the lower sole is shorter than the upper face.

4. The golf club head of claim 1, wherein the channel is defined between the hosel and the toe of the golf club head.

5. The golf club head of claim 1, wherein the channel is defined between the toe and the heel of the golf club head.

6. The golf club head of claim 1, wherein the channel has a width of substantially 0.035 inches.

7. The golf club head of claim 1, wherein the channel has a depth that is substantially 0.02 inches or less.

8. The golf club head of claim 1, wherein the upper face has a radius that is substantially between 0.010 inches to 0.020 inches.

9. The golf club head of claim 1, wherein the channel comprises at least one of a V-shaped configuration, C-shaped configuration, a square-shaped configuration, or a W-shaped configuration.

10. The golf club head of claim 1, wherein the channel comprises a first shape configuration on a first end of the golf club head and a second shape configuration on a second end of the golf club head.

11. A golf club head comprising:
a hosel defining an aperture configured to engage a shaft;
a face formed adjacent the hosel, the face being defined by a heel, a toe, a top edge, and a leading edge,
a back defined opposite the face,
a sole defined between the face and the back, and
an edge configuration that is a boundary between the face and the sole with the edge configuration having a channel that tapers away from the boundary between the face and the sole, wherein the channel is defined between the hosel and the top edge of the golf club head.

12. A golf club head comprising:
a hosel defining an aperture configured to engage a shaft;
a face formed adjacent the hosel, the face being defined by a heel, a toe, a top edge, and a leading edge,
a back defined opposite the face,
a sole defined between the face and the back, and
an edge configuration that is a boundary between the face and the sole with the edge configuration having a channel defined by an upper face and a lower sole wherein the edge configuration comprises at least two sections segmented between a first end and a second end of the golf club head.

13. A golf club head comprising:
a hosel defining an aperture configured to engage a shaft;
a face formed adjacent the hosel, the face being defined by a heel, a toe, a top edge, and a leading edge,
a back defined opposite the face,
a sole defined between the face and the back, and
an edge configuration that is a boundary between the face and the sole with the edge configuration having a channel defined by an upper face formed by the face and a lower sole formed by the sole, wherein the edge configuration comprises a symmetrically tapered configuration extending between a first end and a second end of the golf club head.

14. A golf club head comprising:
a hosel defining an aperture configured to engage a shaft;
a face formed adjacent the hosel, the face being defined by a heel, toe, top edge, and leading edge,
a back defined opposite the face,
a sole defined between the face and the back, and
an edge configuration that is a boundary between the face and the sole with the edge configuration having a channel defined by an upper face formed by the face and a lower sole formed by the sole, wherein the edge configuration comprises a non-symmetrically tapered configuration extending between a first end and a second end of the golf club head.

15. A golf club head comprising:
a hosel defining an aperture configured to engage a shaft;
a face formed adjacent the hosel, the face being defined by a heel, a toe, a top edge, and a leading edge,
a back defined opposite the face, a sole defined between the face and the back, and
an edge configuration that is a boundary between the face and the sole, the edge configuration having a channel defined by a first wall and an opposing second wall defined adjacent a third wall for receiving at least one of water, sand, or grass, wherein the channel tapers away from the boundary between the face and the sole.

16. The golf club head of claim 15, wherein the channel comprises at least one of a V-shaped configuration, C-shaped configuration, a square-shaped configuration, or a W-shaped configuration.

17. The golf club head of claim 15, wherein the channel comprises a channel extending between a first end and a second end of the golf club head, wherein the first end comprises at least one of the toe or the top edge, and wherein the second end comprises at least one of the heel or the hosel.

18. The golf club head of claim 15, wherein the edge configuration comprises at least one of a symmetrically tapered configuration or a non-symmetrically tapered configuration extending between a first end and a second end of the golf club head.

19. A method for manufacturing a club head for a golf club comprising:

forming a golf club head having a hosel that defines an aperture configured to engage a shaft with a face formed adjacent the hosel, the face being defined by a heel, a toe, a top edge, and a leading edge, a back defined opposite the face, and a sole defined between the face and the back, and forming an edge configuration that is the boundary between the face and the sole, wherein the edge configuration defines a channel that tapers away from the boundary between the face and the sole, wherein a lower sole is defined by the sole and an upper face is defined by the face.

20. The method of claim 19, wherein forming the golf club head comprises at least one of casting the edge configuration, forging the edge configuration, or milling the edge configuration.

21. The method of claim 19 further comprising forming a channel associated with the edge configuration, wherein the channel comprises at least one of a V-shaped configuration, C-shaped configuration, a square-shaped configuration, or a W-shaped configuration.

22. The method of claim 19, wherein forming the edge configuration comprises forming an edge configuration between a first end and a second end of the golf club head, wherein the first end comprises at least one of the toe or the top edge, and wherein the second end comprises at least one of the heel or the hosel.

23. The method of claim 19, wherein forming the edge configuration comprises forming at least one of a symmetrically tapered configuration or a non-symmetrically tapered configuration extending between a first end and a second end of the golf club head.

* * * * *